US010063019B1

(12) United States Patent
Back

(10) Patent No.: US 10,063,019 B1
(45) Date of Patent: Aug. 28, 2018

(54) LED LAN CABLE CONNECTOR CAPABLE OF HIGH SPEED DATA TRANSMISSION, LED LAN CABLE CAPABLE OF HIGH SPEED DATA TRANSMISSION, AND LED LAN CABLE SYSTEM CAPABLE OF HIGH SPEED DATA TRANSMISSION

(71) Applicant: CHECKALL INC., Seoul (KR)

(72) Inventor: Seung Bom Back, Goyang-si (KR)

(73) Assignee: CHECKALL INC., Seoul (KR)

( * ) Notice: Subject to any disclaimer, the term of this patent is extended or adjusted under 35 U.S.C. 154(b) by 0 days.

(21) Appl. No.: 15/550,374

(22) PCT Filed: Feb. 22, 2017

(86) PCT No.: PCT/KR2017/001931
§ 371 (c)(1),
(2) Date: Aug. 11, 2017

(87) PCT Pub. No.: WO2018/021644
PCT Pub. Date: Feb. 1, 2018

(30) Foreign Application Priority Data

Jul. 25, 2016 (KR) ..... 10-2016-0094457

(51) Int. Cl.

| | |
|---|---|
| ***H01R 13/71*** | (2006.01) |
| ***H01R 13/717*** | (2006.01) |
| ***H01R 13/66*** | (2006.01) |
| ***H01R 13/02*** | (2006.01) |
| *H01R 4/24* | (2018.01) |

(52) U.S. Cl.
CPC ..... *H01R 13/7175* (2013.01); *H01R 13/025* (2013.01); *H01R 13/6625* (2013.01); *H01R 4/24* (2013.01)

(58) Field of Classification Search
CPC ..... H04Q 1/136; H01R 24/64; H01R 2201/04
See application file for complete search history.

(56) References Cited

U.S. PATENT DOCUMENTS

| | | | | |
|---|---|---|---|---|
| 5,666,453 | A * | 9/1997 | Dannenmann | G02B 6/3895 385/100 |
| 5,847,557 | A * | 12/1998 | Fincher | G01R 31/023 324/66 |
| 6,577,243 | B1 * | 6/2003 | Dannenmann | H01R 13/641 324/66 |
| 6,975,242 | B2 * | 12/2005 | Dannenmann | H01R 13/641 324/66 |
| 7,029,137 | B2 * | 4/2006 | Lionetti | H01B 7/366 362/253 |
| 7,038,135 | B1 * | 5/2006 | Chan | H01R 13/641 174/84 R |
| 7,049,937 | B1 * | 5/2006 | Zweig | H01R 13/641 324/66 |
| 7,221,284 | B2 * | 5/2007 | Scherer | G01R 31/045 340/286.02 |

(Continued)

*Primary Examiner* — Ross Gushi
(74) *Attorney, Agent, or Firm* — Patent Office of Dr. Chung Park

(57) ABSTRACT

The present disclosure relates to an LED LAN cable connector capable of high speed data transmission, and according to the present disclosure, it is possible to effectively prevent the data speed from decreasing and the data from being blocked when applying external power source to the LAN cable connector where an LED is installed.

10 Claims, 7 Drawing Sheets

(56) References Cited

U.S. PATENT DOCUMENTS 7,294,786 B2 * 11/2007 Aldereguia ..... G02B 6/447 174/84 R
7,327,278 B2 * 2/2008 Dannenmann ..... G01R 31/041 324/66
7,488,206 B2 * 2/2009 Caveney ..... H04Q 1/136 439/540.1
7,605,707 B2 * 10/2009 German ..... H01R 13/465 340/572.7
7,636,050 B2 * 12/2009 Nordin ..... H01R 13/641 340/635
7,938,700 B2 * 5/2011 Jacks ..... H01R 13/641 361/780
8,014,518 B2 * 9/2011 King ..... H04Q 1/136 340/687
8,033,873 B2 * 10/2011 Ankerstjerne ..... H01R 13/465 379/22.03
8,116,434 B2 * 2/2012 German ..... H01R 13/6683 379/32.01
8,128,428 B2 * 3/2012 Caveney ..... H04Q 1/149 439/490
8,142,221 B2 * 3/2012 Malstron ..... H01R 13/665 439/489
8,267,706 B2 * 9/2012 Patel ..... H01R 13/703 439/188
8,340,093 B2 * 12/2012 Shifris ..... H04Q 1/136 370/389
8,344,900 B2 * 1/2013 Fariello ..... H04Q 1/116 340/568.4
8,414,319 B2 * 4/2013 Patel ..... H01R 13/703 439/188
8,588,050 B2 * 11/2013 Caveney ..... H04Q 1/136 370/200
8,611,234 B1 * 12/2013 Gershman ..... H04Q 1/136 370/251
8,624,577 B2 * 1/2014 Bradley, II ..... H04L 43/50 200/51.07
8,909,013 B1 * 12/2014 Jiang ..... G02B 6/4416 385/100
8,992,260 B2 * 3/2015 Coffey ..... H01R 13/641 439/620.22
9,019,968 B2 * 4/2015 Shar ..... H04Q 1/136 370/400
9,196,975 B2 * 11/2015 Scherer ..... H01R 9/032
9,213,151 B2 * 12/2015 Lin ..... G02B 6/3895
9,426,032 B2 * 8/2016 Caveney ..... H04Q 1/136
9,538,262 B2 * 1/2017 German ..... H04Q 1/136
9,824,552 B2 * 11/2017 Ward ..... G08B 5/38
9,838,761 B2 * 12/2017 Caveney ..... H04Q 1/136
9,866,458 B2 * 1/2018 Jacks ..... H04L 43/0811
9,877,090 B2 * 1/2018 Cohard ..... H04Q 11/0005
9,887,499 B2 * 2/2018 Hirano ..... H01R 13/717
9,924,241 B2 * 3/2018 Shih ..... H04Q 1/136
9,952,258 B2 * 4/2018 Scherer ..... G01R 19/155
2003/0152344 A1 * 8/2003 Brunet ..... G02B 6/4415 385/100
2005/0052174 A1 * 3/2005 Angelo ..... H01R 13/7172 324/66
2005/0111491 A1 * 5/2005 Caveney ..... H04M 3/229 370/475
2011/0043333 A1 * 2/2011 German ..... H04Q 1/136 340/10.1

* cited by examiner

LED LAN CABLE CONNECTOR CAPABLE OF HIGH SPEED DATA TRANSMISSION, LED LAN CABLE CAPABLE OF HIGH SPEED DATA TRANSMISSION, AND LED LAN CABLE SYSTEM CAPABLE OF HIGH SPEED DATA TRANSMISSION

FIELD

The present invention relates to an LED LAN cable connector capable of high speed data transmission, an LED LAN cable capable of high speed data transmission, and an LED LAN cable system capable of high speed data transmission, and more particularly, to an LED LAN cable connector capable of high speed data transmission, an LED LAN cable capable of high speed data transmission and an LED LAN cable system capable of high speed data transmission, that can also effectively prevent the data speed from decreasing and the data from being blocked when applying external power to the LAN cable connector where an LED is installed.

BACKGROUND

A LAN cable (Local Area Network cable) is a cable that is necessary when using a wired network, and that is used to mutually connect various network devices.

It is essential to use the aforementioned LAN cable in not only large scale facilities equipped with large scale network facilities, such as general companies, government offices, schools, hospitals and the like, but also where small scale network devices are installed, such as small offices, restaurants, houses and the like.

When a problem occurs in such network devices, the operator must first find out into which port of which device the LAN cable is inserted.

Large scale network devices, that are installed in large scale facilities, such as large companies, government offices and the like, are mutually connected via an enormous number of LAN cables. Therefore, with the conventional method of individually checking both ends of a plurality of LAN cables that connect the network devices, it is difficult for the operator to identify into which port of which device the LAN cable is inserted.

In order to facilitate the operation of checking the LAN cables described above, conventional technologies used the method of attaching a tag to each LAN cable. For this method to be properly effective, in the case of replacing or exchanging a network device, the tag must be replaced as well. However, this replacement operation described above is not being implemented perfectly in the field due to operators being replaced and the negligence of maintenance and so on. Therefore, due to the un-replaced tags, it takes a lot of time and manpower to repair and maintain the network.

For the operation of checking the LAN cables, a technology was proposed to install an LED in each LAN cable connector at the receiving side and at the transmitting side, and to apply external power to identify whether the LEDs at both sides are turned on.

This technology operates normally under the standards of data transmission speed of not more than 100 Mps, but under the standards such as CAT5E, CAT6, and CAT7 where data must be transmitted at a speed of 100 Mps or above, problems such as decrease of data transmission speed and data blocking occurred due to the external power source.

SUMMARY

Therefore, a purpose of the present disclosure is to solve the aforementioned problems of prior art, that is, to provide an LED LAN cable connector capable of high speed data transmission, an LED LAN cable capable of high speed data transmission and an LED LAN cable system capable of high speed data transmission, that can also effectively prevent the data speed from decreasing and the data from being blocked when applying external power source to the LAN cable connector where an LED is installed.

The aforementioned purpose is achieved by an LED LAN cable connector capable of high speed data transmission installed in each of both end portions of a cable including a first line and a second line, the connector including a main body unit connected to the end portion of the cable; a substrate unit that is installed in the main body unit, and that is provided with a power source terminal to receive input of external power source and a condenser installed to receive the power source and convert the power source, the substrate unit connected to each of the first line and the second line so that the power source can be transmitted to the first line and the second line; and a light emitting unit that is installed in the substrate unit, and that receives the power source from the condenser and emits light.

Further, the power source may include a pulse signal.

Further, the main body unit may include a front end portion that is inserted into a port, a rear end portion installed at the end portion of the cable, and an intermediate end portion that is installed at the front end portion, has the substrate unit installed in the intermediate end portion, and forms an opening so that the light emitting unit is exposed to outside.

Further, the main body unit may further include a lower end portion that is detachably installed to a lower surface of the intermediate end portion.

The aforementioned purpose is achieved by an LED LAN cable capable of high speed data transmission, the LED LAN cable including the cable that includes a first line and a second line; a substrate unit that is installed in the main body unit, and that is provided with a power source terminal to receive input of external power source and a condenser installed to receive the power source and convert the power source, the substrate unit connected to each of the first line and the second line so that the power source can be transmitted to the first line and the second line; and a light emitting unit that is installed in the substrate unit, and that receives the power source from the condenser and emits light.

Further, the power source may include a pulse signal.

Further, the main body unit may include a front end portion that is inserted into a port, a rear end portion installed at the end portion of the cable, and an intermediate end portion that is installed at the front end portion, has the substrate unit installed in the intermediate end portion, and forms an opening so that the light emitting unit is exposed to outside.

Further, the main body unit may further include a lower end portion that is detachably installed to a lower surface of the intermediate end portion.

The aforementioned purpose is achieved by an LED LAN cable system capable of high speed data transmission, the system including a cable that includes a first line and a second line; a main body unit connected to an end portion of the cable; a substrate unit that is installed in the main body unit, and that is provided with a power source terminal to receive input of external power source and a condenser installed to receive the power source and convert the power source, the substrate unit connected to each of the first line and the second line so that the power source can be transmitted to the first line and the second line; a light emitting unit that is installed in the substrate unit, and that receives the power source from the condenser and emits light; and a power source unit that supplies the power source to the power source terminal.

Further, the power source unit may include a base unit, a contact unit that is installed in the base unit and that contacts the power source terminal, a supply unit that supplies the power source to the contact unit, and a pulse generation module that generates a pulse signal and transmits the pulse signal to the contact unit.

According to the present disclosure, it is possible to effectively prevent the data speed from decreasing and the data from being blocked when applying external power source to the LAN cable connector where an LED is installed.

DETAILED DESCRIPTION

Hereinbelow, an LED LAN cable connector capable of high speed data transmission according to an embodiment of the present disclosure will be explained with reference to the attached drawings.

Figure 1:
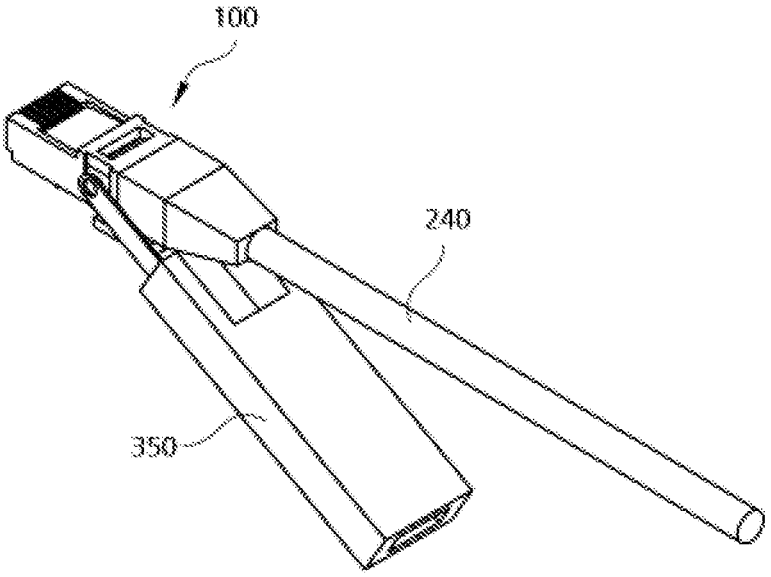
FIG. 1 is a view illustrating the overall configuration of an LED LAN cable connector capable of high speed data transmission according to an embodiment of the present disclosure.
Figure 2:
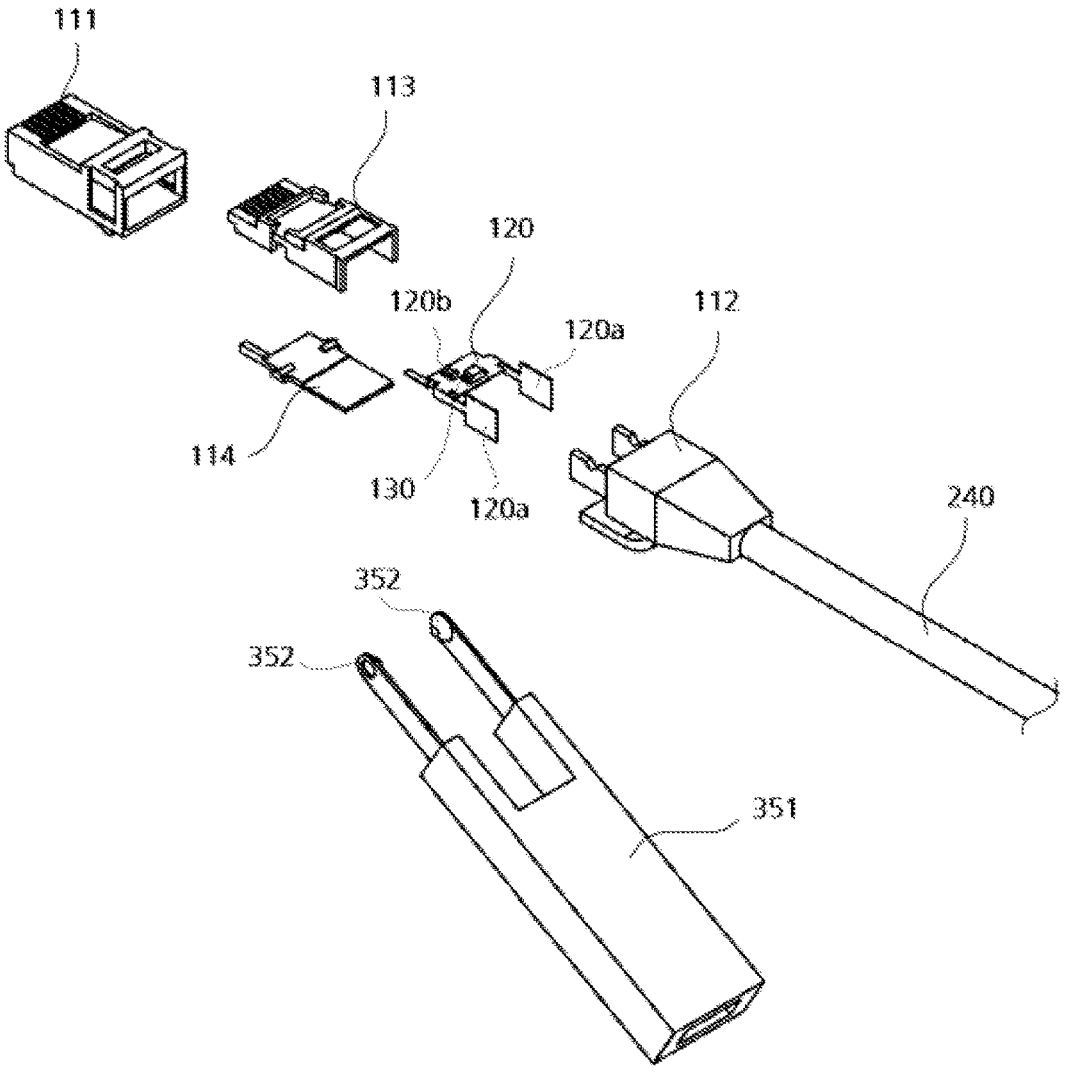
FIG. 2 is an exploded perspective view of the LED LAN cable connector capable of high speed data transmission according to an embodiment of the present disclosure.
Figure 3:
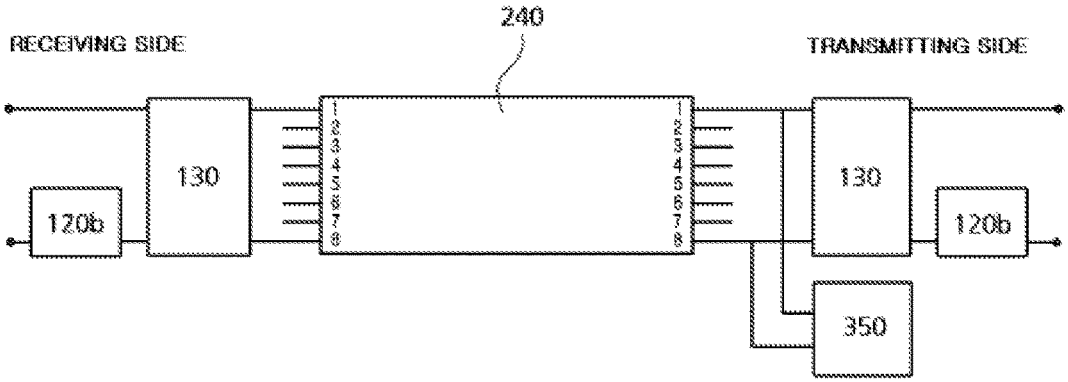
FIG. 3 is a view illustrating the electrical connection between components of the LED LAN cable connector capable of high speed data transmission according to an embodiment of the present disclosure.
Figure 4:
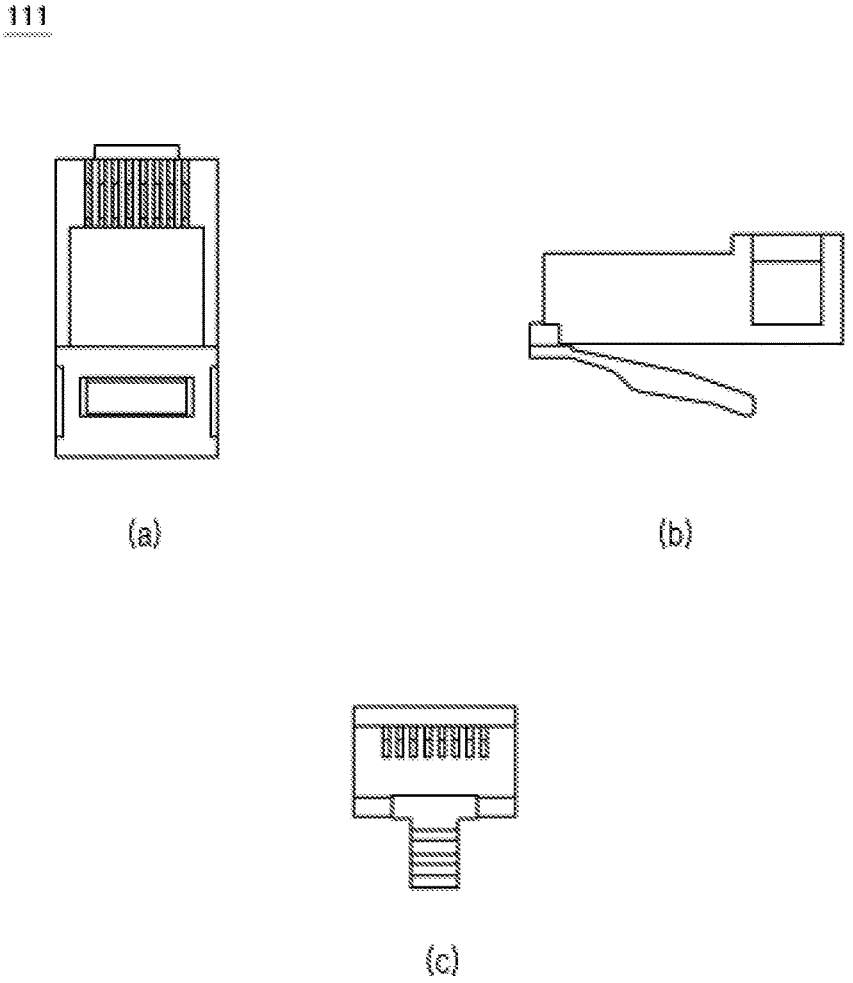
FIG. 4 are views illustrating a front end portion of the LED LAN cable connector capable of high speed data transmission according to an embodiment of the present disclosure.
Figure 5:
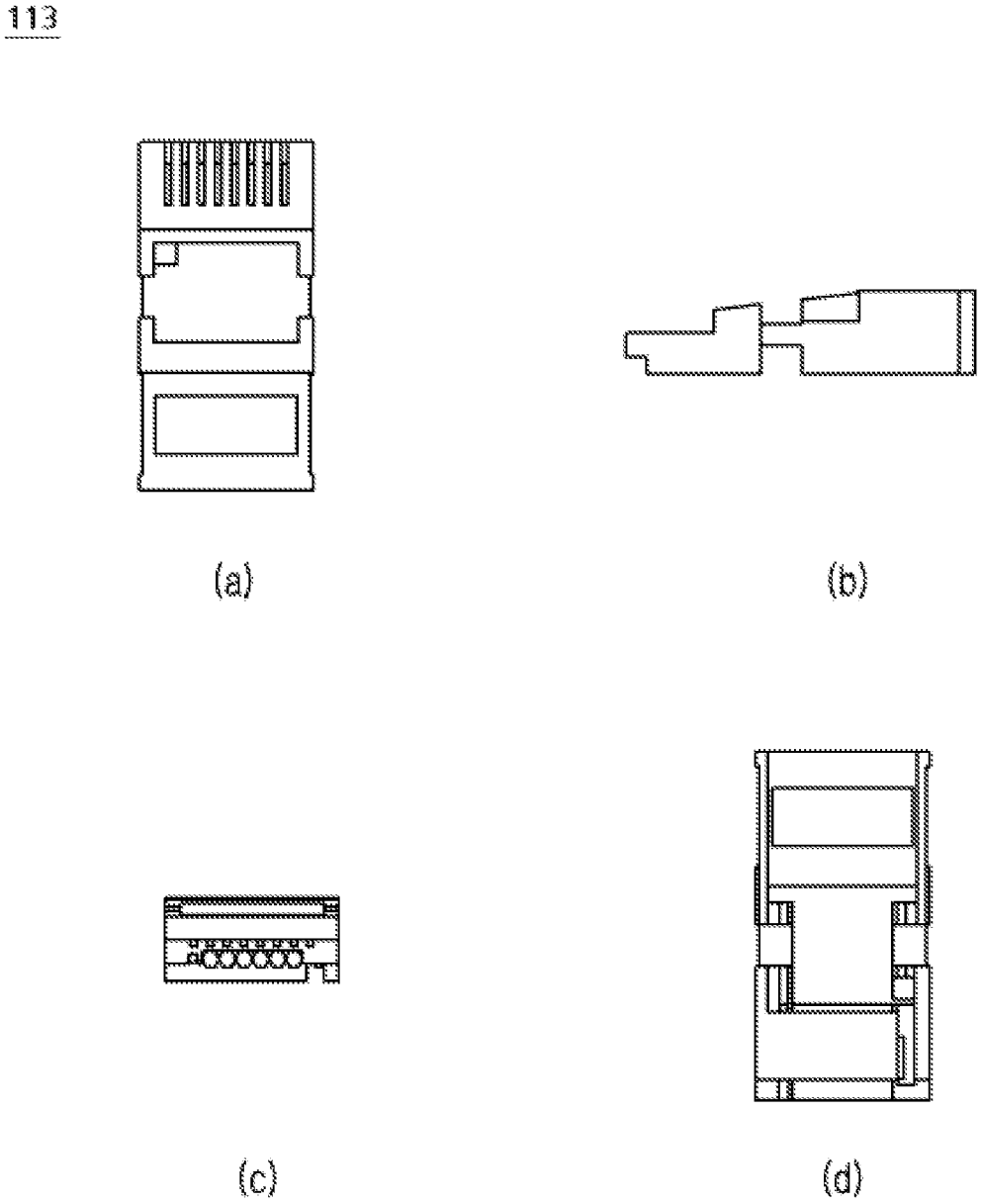
FIG. 5 are views illustrating an intermediate end portion of the LED LAN cable connector capable of high speed data transmission according to an embodiment of the present disclosure.
Figure 6:
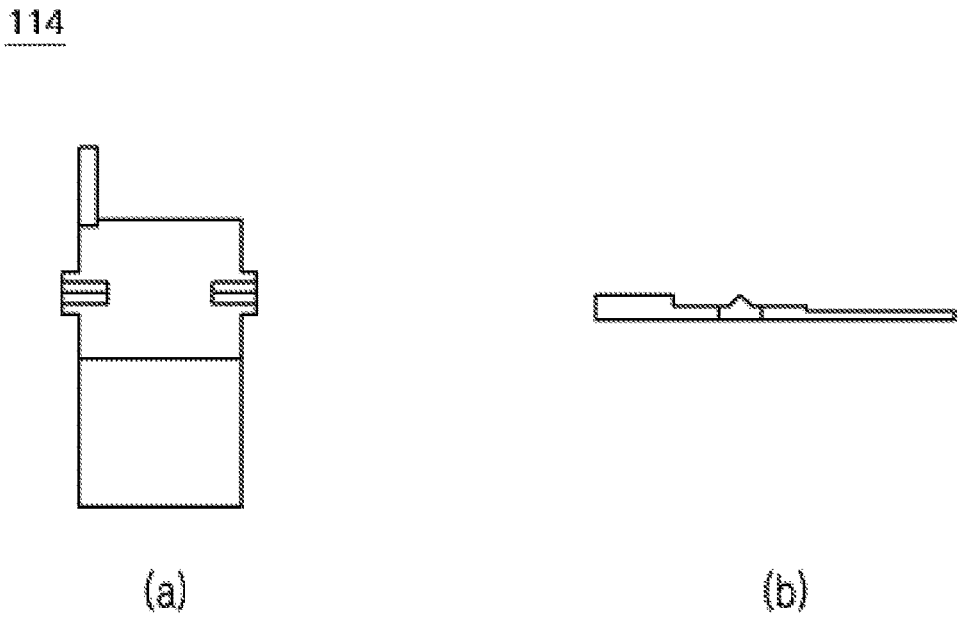
FIG. 6 are views illustrating a lower end portion of the LED LAN cable connector capable of high speed data transmission according to an embodiment of the present disclosure.
Figure 7:
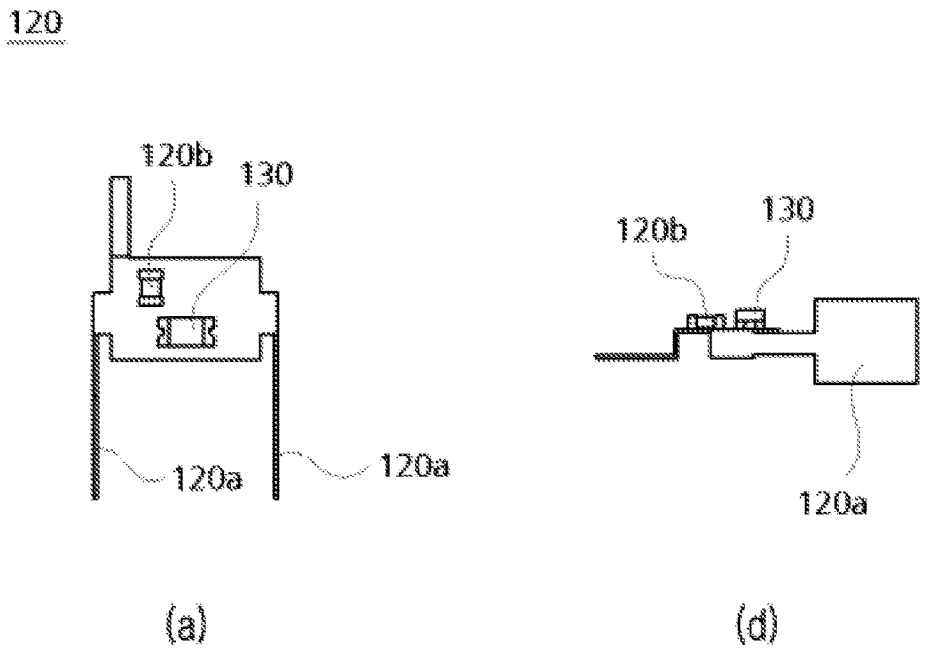
FIG. 7 are views illustrating a substrate unit of the LED LAN cable connector capable of high speed data transmission according to an embodiment of the present disclosure.

FIG. 1 is a view illustrating the overall configuration of an LED LAN cable connector capable of high speed data transmission according to an embodiment of the present disclosure, FIG. 2 is an exploded perspective view of the LED LAN cable connector capable of high speed data transmission according to an embodiment of the present disclosure, FIG. 3 is a view illustrating the electrical connection between components of the LED LAN cable connector capable of high speed data transmission according to an embodiment of the present disclosure, FIG. 4 are views illustrating a front end portion of the LED LAN cable connector capable of high speed data transmission according to an embodiment of the present disclosure, FIG. 5 are views illustrating an intermediate end portion of the LED LAN cable connector capable of high speed data transmission according to an embodiment of the present disclosure, FIG. 6 are views illustrating a lower end portion of the LED LAN cable connector capable of high speed data transmission according to an embodiment of the present disclosure and FIG. 7 are views illustrating a substrate unit of the LED LAN cable connector capable of high speed data transmission according to an embodiment of the present disclosure.

As illustrated in FIGS. 1 to 7, the LED LAN cable connector 100 capable of high speed data transmission according to an embodiment of the present disclosure includes a main body unit 110, a substrate unit 120, and a light emitting unit 130.

The main body unit 110 is an element configured to be connected to an end portion of a cable 240, and where the substrate unit 120 that will be described hereinbelow is installed. Such a main body unit 110 includes a front end portion 111, a rear end portion 112, an intermediate end portion 113 and a lower end portion 114.

The front end portion 111 is an element configured to be inserted into a port, and where the intermediate end portion 113 that will be described hereinbelow is inserted and installed. Both side surfaces of the front end portion 111 are opened such that a power source terminal **120*a* formed in the substrate unit 120 as will be described hereinbelow is exposed to outside, and an upper surface of the front end portion 111 is opened such that the light emitting unit 130 installed in the substrate unit 120** is exposed to outside.

The rear end portion 112 is an element configured to be installed at an end portion of the cable 240, and where the intermediate end portion that will be described hereinbelow is installed.

The intermediate end portion 113 is an element where the substrate unit 120 that will be described hereinbelow is installed, and that is inserted and installed in the front end portion 111 described above. On a front surface of the intermediate end portion 113, a plurality of line grooves are formed such that end portions of a plurality of lines configuring the cable 240 can be inserted and installed.

Further, the intermediate end portion 113 defines an opening on its upper surface such that the light emitting unit 130 installed in the substrate unit 120 is exposed to outside.

The lower end portion 114 is an element configured to be installed on a lower surface of the intermediate end portion 113, and that is detachably installed to the lower surface of the intermediate end portion 113. By this lower end portion 114, when a problem occurs in the substrate unit 120, the substrate unit 120 can be easily removed from the intermediate end portion 113.

The substrate unit 120 is an element configured to be installed in the intermediate end portion 113 of the main body unit 110 as described above, and where the power source terminal **120*a* is formed such that external power source can be input. The substrate unit 120 is connected to each of an arbitrary first line and second line, i.e., the lines that are transmitting data, of a plurality of lines included in the cable, so that the power source can be transmitted to those first line and second line. On the upper surface of the substrate unit 120, the light emitting unit 130** is installed as will be described hereinbelow.

Further, in the substrate unit 120, a condenser 120*b* for receiving power source from the power source terminal 120*a*, is installed. Such a condenser 120*b* receives input of the external power source and pulse included in the power source to process the characteristics of the power source. That is, the condenser 120*b* converts the power source to have a predetermined cycle and amplitude corresponding to the standards such as CAT5E, CAT6 and CAT7 for transmitting data at a speed of 100 MPs or above. The converted power source is supplied to the light emitting unit 130 at the receiving side through the first line and the second line and enables the light emitting unit 130 to emit light.

When it is confirmed that a signal other than a data signal is input, a system that operates under the standards such as CAT5E, CAT6 and CAT7 for transmitting data at a speed of 100 Mps or above, perceives the signal as noise and thus either blocks the data or significantly reduces the data transmission speed. Therefore, when external power source is supplied to the light emitting unit 130 as it is, the power source perceived as the signal other than the data signal, is input into the system along the first line and the second line connected to the light emitting unit 130, thus causing the problem of blocking the data or significantly decreasing the data transmission speed.

Therefore, when the power source including a pulse is input into the condenser 120*b* as described above, the power source for enabling a pair of light emitting units 130 to emit light, is supplied to the light emitting unit 130, and at the same time, the power source of the form corresponding to the standards such as CAT5E, CAT6 and CAT7 for transmitting data at a speed of 100 Mps or above, that is, the signal not perceived as noise can be supplied to the first line and the second line, and therefore, it is possible to enable both the light emitting unit 130 at the receiving side and the transmitting side to emit light, and at the same time effectively prevent the conventional problem of data blocking and decrease of the data transmission speed.

The light emitting unit 130 is an element configured to receive the power source and emit light, and is installed in the substrate unit 120.

The cable 240 generally includes eight lines, of which two arbitrary lines, i.e., the first line and the second line mutually electrically connect the light emitting unit 130 at the transmitting side and the light emitting unit 130 at the receiving side 130.

As described above, the light emitting unit 130 at the receiving side and the light emitting unit 130 at the transmitting side 130 are mutually electrically connected via the first line and the second line, and thus when the operator supplies power source to the light emitting unit 130 at the transmitting side, the light emitting unit 130 at the transmitting side emits light, and at the same time, the power source is supplied to the light emitting unit 130 at the receiving side, enabling the light emitting unit 130 at the receiving side to emit light as well.

Therefore, by the light emitting unit 130 as described above, the operator can effectively identify into which port of which device both ends of the cable 240 are inserted, thus providing an effect of easy maintenance, repair and management of the network system.

Such a light emitting unit 130 may be made of an LED (Light Emitting Diode) module, but without limitation thereto, and thus the light emitting unit 130 may be made of any material as long as it can receive the power source and emit light.

Therefore, according to the LED LAN cable connector 100 capable of high speed data transmission according to an embodiment of the present disclosure that includes the substrate unit 120 and the light emitting unit 130, it is possible to provide an LED LAN cable connector 100 capable of high speed data transmission, that can also effectively operate under the standards such as CAT5E, CAT6 and CAT7 for transmitting data at a speed of 100 MPs or above.

Hereinbelow, an LED LAN cable capable of high speed data transmission according to an embodiment of the present disclosure will be explained in detail with reference to the attached drawings.

The LED LAN cable 200 capable of high speed data transmission according to an embodiment of the present disclosure includes a main body unit 110, a substrate unit 120, a light emitting unit 130 and a cable 240.

However, the main body unit 110, the substrate unit 120 and the light emitting unit 130 of the present embodiment of the present disclosure are identical to the elements of the LED LAN cable connector 100 capable of high speed data transmission according to the embodiment of the present disclosure explained hereinabove, and thus repeated explanation is omitted.

Figure 8:
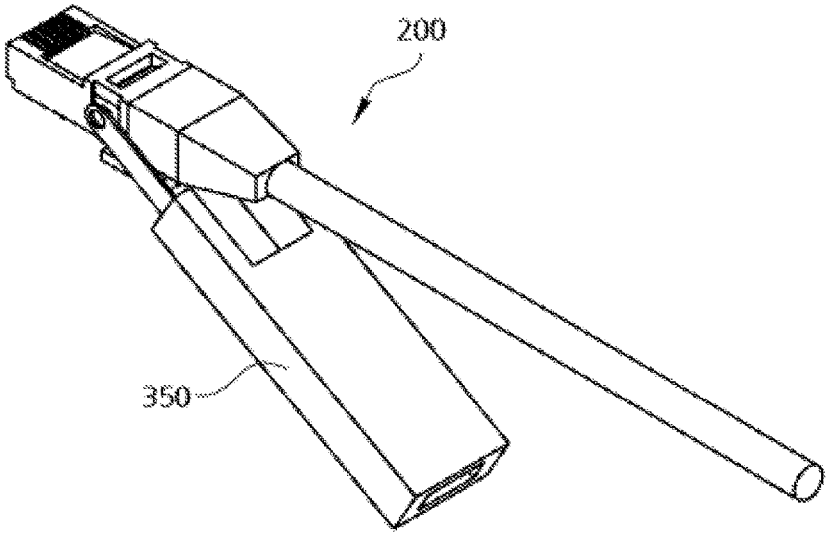
FIG. 8 is a view illustrating the overall configuration of an LED LAN cable capable of high speed data transmission according to an embodiment of the present disclosure.

FIG. 8 is a view illustrating the overall configuration of the LED LAN cable capable of high speed data transmission according to an embodiment of the present disclosure.

As illustrated in FIG. 8, the cable 240 includes a first line and a second line, and the main body unit 110 is installed in each of both end portions of the cable 240. That is, at both end portions of the cable 240, the main body unit 110 is installed by being inserted into the both end portions of the cable 240.

Such a cable 240 is an element provided for use in network communication, and includes a plurality of lines therein. There may be generally eight lines. Of these eight lines, the first line and the second line mutually connect the light emitting unit 130 at the transmitting side and the light emitting unit 130 at the receiving side.

As described above, according to the LED LAN cable 200 capable of high speed data transmission according to an embodiment of the present disclosure that includes the main body unit 110, the substrate unit 120, the light emitting unit 130 and the cable 240, it is possible to provide an LED LAN cable 200 capable of high speed data transmission, that can also effectively operate under the standards such as CAT5E, CAT6, and CAT7 for transmitting data at a speed of 100 Mps or above.

Hereinbelow, an LED LAN cable system capable of high speed data transmission according to an embodiment of the present disclosure will be explained in detail.

The LED LAN cable system 300 capable of high speed data transmission according to an embodiment of the present disclosure includes a main body unit 110, a substrate unit 120, a light emitting unit 130, a cable 240 and a power source unit 350.

However, the main body unit 110, the substrate unit 120, the light emitting unit 130 and the cable 240 of the present embodiment of the present disclosure are identical to the elements of the LED LAN cable 200 capable of high speed data transmission according to the embodiment of the present disclosure explained hereinabove, and thus repeated explanation is omitted.

Figure 9:
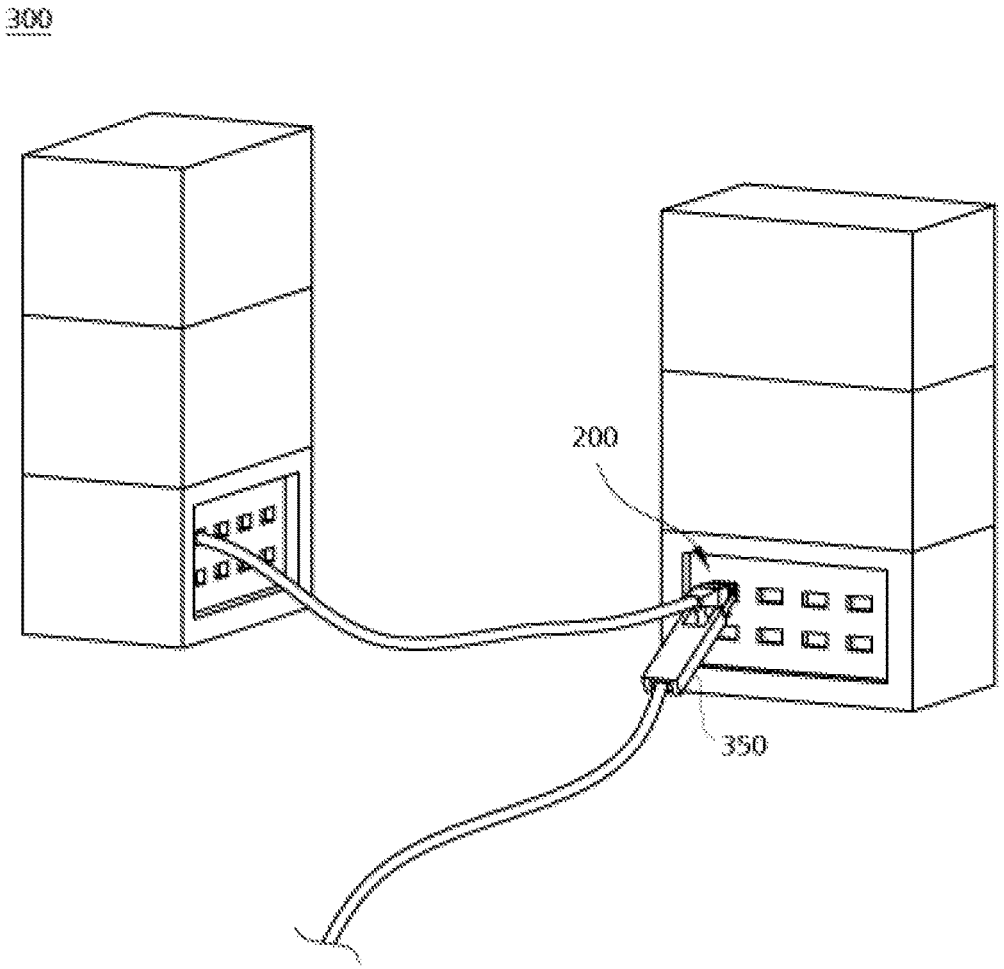
FIG. 9 is a view illustrating an LED LAN cable system capable of high speed data transmission according to an embodiment of the present disclosure.
Figure 10:
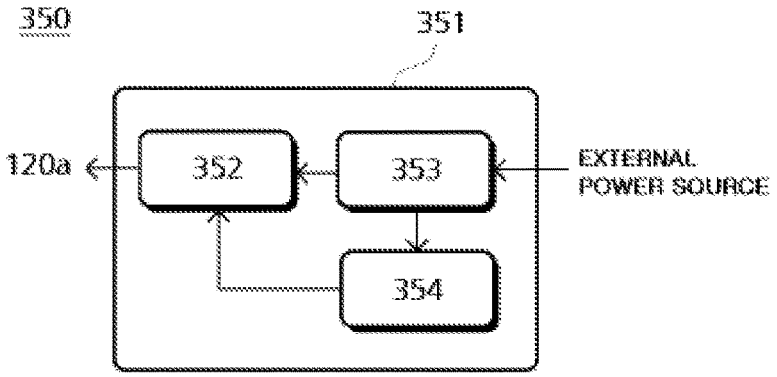
FIG. 10 is a view illustrating the electrical connection of the configuration of a power source unit of the LED LAN cable system capable of high speed data transmission according to an embodiment of the present disclosure.

FIG. 9 is a view illustrating an LED LAN cable system capable of high speed data transmission according to an embodiment of the present disclosure, and FIG. 10 is a view illustrating the electrical connection of the configuration of the power source unit of the LED LAN cable system capable of high speed data transmission according to an embodiment of the present disclosure.

As illustrated in FIG. 9 and FIG. 10, the power source unit 350 is an element configured to supply power source to the power source terminal 120*a*, and includes a base unit 351, a contact unit 352, a supply unit 353 and a pulse generation module 354.

The base unit 351 is an element configured to provide space to accommodate the supply unit 353 and the pulse generation module 354 as will be explained hereinbelow, and at each of one pair of end portions diverging and extending from one side surface of the base unit 351, the contact unit 352 is installed.

The contact unit 352 is an element configured to be installed at the one pair of end portions formed in the base unit as described above. The contact unit 352 receives the power source from the supply unit 353 as will be described hereinbelow, and contacts the power source terminal 120*a*, thereby supplying the power source to the power source terminal 120*a*.

The supply unit 353 is an element configured to supply power source to the contact unit 352 described above, and the supply unit 353 may be provided in a form where a battery is embedded therein, or in a form of being connected to an external power source device.

In the case where the supply unit 353 is provided in the form where a battery is embedded therein, the battery may be charged with external power source via wires, or wirelessly.

Further, in the case where the supply unit 353 is provided in the form of being connected to an external power source device, in order to connect the supply unit 353 to the external power source device, it is preferable that a penetration groove is formed at another end portion of the base unit 351 so that a power source connector can be installed therein.

The pulse generation module 354 is an element configured generate a pulse signal and transmit the generated pulse signal to the contact unit 352 described above.

Such a pulse signal generated by the pulse generation module 354 is supplied to the condenser 120*a* together with the power source, and the condenser 120*b* receives input of the pulse and power source and provides the characteristics of the power source, thereby converting the power source to have a predetermined cycle and amplitude corresponding to the standards such as CAT5E, CAT6 and CAT7 for transmitting data at a speed of 100 Mps or above.

As described above, according to the LED LAN cable system 300 capable of high speed data transmission according to an embodiment of the present disclosure, that includes the main body unit 110, the substrate unit 120, the light emitting unit 130, the cable 240 and the supply unit 353, it is possible to provide the LED LAN cable system 300 capable of high speed data transmission, that can also effectively operate under the standards such as CAT5E, CAT6, and CAT7 for transmitting data at a speed of 100 Mps or above.

The right of the scope of the present disclosure is not limited to the aforementioned embodiments but may be realized in various types of embodiments within the claims attached hereto. It will be apparent to one of ordinary skill in the art that various changes in form and details may be made in these examples without departing from the spirit and scope of the claims and their equivalents.

What is claimed is:

1. An LED LAN cable connector capable of high speed data transmission installed in each of both end portions of a cable comprising a first line and a second line, the connector comprising:

a main body unit connected to the end portion of the cable;

a substrate unit that is installed in the main body unit, and that is provided with a power source terminal to receive input of external power source and a condenser installed to receive the power source and convert the power source, the substrate unit connected to each of the first line and the second line so that the power source can be transmitted to the first line and the second line; and a light emitting unit that is installed in the substrate unit, and that receives the power source from the condenser and emits light.

2. The LED LAN cable connector capable of high speed data transmission of claim 1, wherein the power source comprises a pulse signal.

3. The LED LAN cable connector capable of high speed data transmission of claim 1, wherein the main body unit comprises a front end portion that is inserted into a port, a rear end portion installed at the end portion of the cable, and an intermediate end portion that is installed at the front end portion, has the substrate unit installed in the intermediate end portion, and forms an opening so that the light emitting unit is exposed to outside.

4. The LED LAN cable connector capable of high speed data transmission of claim 3, wherein the main body unit further comprises a lower end portion that is detachably installed to a lower surface of the intermediate end portion.

5. An LED LAN cable capable of high speed data transmission, the cable comprising:

the cable that comprises a first line and a second line;

a substrate unit that is installed in the main body unit, and that is provided with a power source terminal to receive input of external power source and a condenser installed to receive the power source and convert the power source, the substrate unit connected to each of the first line and the second line so that the power source can be transmitted to the first line and the second line; and a light emitting unit that is installed in the substrate unit, and that receives the power source from the condenser and emits light.

6. The LED LAN cable capable of high speed data transmission of claim 5, wherein the power source comprises a pulse signal.

7. The LED LAN cable capable of high speed data transmission of claim 5, wherein the main body unit comprises a front end portion that is inserted into a port, a rear end portion installed at the end portion of the cable, and an intermediate end portion that is installed at the front end portion, has the substrate unit installed in the intermediate end portion, and forms an opening so that the light emitting unit is exposed to outside.

8. The LED LAN cable capable of high speed data transmission of claim 7, wherein the main body unit further comprises a lower end portion that is detachably installed to a lower surface of the intermediate end portion.

9. An LED LAN cable system capable of high speed data transmission, the system comprising:

a cable that comprises a first line and a second line;

a main body unit connected to an end portion of the cable;

a substrate unit that is installed in the main body unit, and that is provided with a power source terminal to receive input of external power source and a condenser installed to receive the power source and convert the power source, the substrate unit connected to each of the first line and the second line so that the power source can be transmitted to the first line and the second line;

a light emitting unit that is installed in the substrate unit, and that receives the power source from the condenser and emits light; and a power source unit that supplies the power source to the power source terminal.

10. The LED LAN cable system capable of high speed data transmission of claim 9, wherein the power source unit comprises:

a base unit, a contact unit that is installed in the base unit and that contacts the power source terminal, a supply unit that supplies the power source to the contact unit, and a pulse generation module that generates a pulse signal and transmits the pulse signal to the contact unit.

* * * * *